US011034514B2

(12) United States Patent
Petz et al.

(10) Patent No.: US 11,034,514 B2
(45) Date of Patent: Jun. 15, 2021

(54) ACTIVELY COOLED WASTE RECEPTACLE

(71) Applicant: Petal Incorporated, Toronto (CA)

(72) Inventors: Brian Petz, Toronto (CA); Primoz Cresnik, Toronto (CA)

(73) Assignee: PETAL INCORPORATED, Toronto (CA)

( * ) Notice: Subject to any disclaimer, the term of this patent is extended or adjusted under 35 U.S.C. 154(b) by 62 days.

(21) Appl. No.: 16/319,740

(22) PCT Filed: Aug. 10, 2016

(86) PCT No.: PCT/IB2016/054821
§ 371 (c)(1),
(2) Date: Jan. 22, 2019

(87) PCT Pub. No.: WO2018/029510
PCT Pub. Date: Feb. 15, 2018

(65) Prior Publication Data
US 2019/0218029 A1 Jul. 18, 2019

(51) Int. Cl.
*B65F 1/14* (2006.01)
*B65F 1/06* (2006.01)
(Continued)

(52) U.S. Cl.
CPC ..... *B65F 1/1426* (2013.01); *B65F 1/00* (2013.01); *B65F 1/06* (2013.01); *B65F 1/08* (2013.01);
(Continued)

(58) Field of Classification Search
CPC ..... F65F 2210/116; F65F 1/08; F65F 1/1468; B65F 2210/116; B65F 1/08; B65F 1/1468; F25D 21/08
See application file for complete search history.

(56) References Cited

U.S. PATENT DOCUMENTS 3,161,030 A 12/1964 Brewton
3,261,179 A * 7/1966 Dill ..... F25D 25/02 62/382
(Continued)

FOREIGN PATENT DOCUMENTS

BE 1014119 A3 5/2003
DE 4424002 A1 2/1996
(Continued)

OTHER PUBLICATIONS

WIPO/IB, International Preliminary Report on Patentability, dated Feb. 21, 2019, re PCT International Patent Application No. PCT/IB2016/054821.
(Continued)

*Primary Examiner* — Cassey D Bauer
(74) *Attorney, Agent, or Firm* — Perry + Currier

(57) ABSTRACT

An actively cooled waste receptacle comprises an insulated container including (i) an inner wall defining a chamber having an opening for receiving the waste, and (ii) an outer wall surrounding the inner wall and joined to the inner wall at the opening. The receptacle also includes a cover configured to prevent access to the chamber via the opening in a closed position, and to allow access to the chamber via the opening in an open position; and a heat pump including an interior heat exchanger exposed to the chamber, the heat pump configured to cool the chamber by absorbing heat from air within the chamber via the interior heat exchanger, and transferring the heat outside the insulated container.

24 Claims, 12 Drawing Sheets

(51) Int. Cl.

| | |
|---|---|
| ***B65F 1/08*** | (2006.01) |
| ***B65F 1/16*** | (2006.01) |
| ***F25D 21/08*** | (2006.01) |
| ***B65F 1/00*** | (2006.01) |
| ***F25B 21/02*** | (2006.01) |
| ***F25D 17/06*** | (2006.01) |
| ***F25B 1/00*** | (2006.01) |
| *F25B 47/02* | (2006.01) |

(52) U.S. Cl.

CPC ..... *B65F 1/14* (2013.01); *B65F 1/1436* (2013.01); *B65F 1/1468* (2013.01); *B65F 1/1473* (2013.01); *B65F 1/163* (2013.01); *B65F 1/1607* (2013.01); *F25B 1/00* (2013.01); *F25B 21/02* (2013.01); *F25D 17/06* (2013.01); *F25D 21/08* (2013.01); *B65F 2001/1676* (2013.01); *B65F 2210/116* (2013.01); *F25B 47/02* (2013.01); *F25B 2700/2104* (2013.01); *F25B 2700/2117* (2013.01); *F25D 2700/12* (2013.01)

(56) References Cited

U.S. PATENT DOCUMENTS

| | | | | | |
|---|---|---|---|---|---|
| 3,702,544 | A * | 11/1972 | Grinups | F25D 17/06 | 62/414 |
| 5,291,746 | A * | 3/1994 | Abbott | B65F 1/02 | 414/420 |
| 2007/0074531 | A1* | 4/2007 | Holder | A61L 9/01 | 62/440 |
| 2008/0202141 | A1 | 8/2008 | Lim et al. | | |
| 2008/0264069 | A1* | 10/2008 | Dorsey | B65F 1/1607 | 62/3.6 |
| 2009/0277187 | A1 | 11/2009 | McGann | | |
| 2012/0118895 | A1* | 5/2012 | Lin | B65F 1/08 | 220/495.11 |

FOREIGN PATENT DOCUMENTS

| | | | | | |
|---|---|---|---|---|---|
| DE | 19650301 | A1 | | 12/1996 | |
| DE | 10126479 | A1 | | 12/2002 | |
| EP | 0055236 | | * | 6/1982 | B30B 9/3003 |
| FR | 2740759 | | * | 9/1997 | B65F 1/1426 |
| GB | 2463023 | A | | 3/2010 | |
| JP | S57141901 | U | | 9/1982 | |
| JP | H01285502 | A | | 11/1989 | |
| JP | H03070972 | A | | 3/1991 | |
| JP | 2000229702 | A | | 8/2000 | |
| JP | 2004035201 | A | | 2/2004 | |
| JP | 2006046841 | A | | 2/2006 | |
| JP | 3131435 | U | | 5/2007 | |
| JP | 2015120577 | A | | 7/2015 | |
| KR | 20070105956 | | * | 10/2007 | B09B 3/00 |
| KR | 20140099763 | A | | 8/2014 | |
| KR | 101463610 | | * | 11/2014 | B65C 1/0033 |
| WO | WO-2014186367 | A1 | | 11/2014 | |

OTHER PUBLICATIONS

International Search Report dated Apr. 26, 2017 for PCT International Application No. PCT/IB2016/054821.

Written Opinion of the International Searching Authority dated Apr. 26, 2017 for PCT Internatonal Applicaiton No. PCT/IB2016054821.

BRPTO, Preliminary Office Action with English translation, dated Jun. 16, 2020 re Brazilian Patent Application No. 1120190025251.

* cited by examiner

ACTIVELY COOLED WASTE RECEPTACLE

FIELD

The specification relates generally to waste storage, and specifically to an actively cooled waste receptacle.

BACKGROUND

Various facilities, including commercial, industrial, medical, and residential locations, employ provisional waste storage prior to transporting the waste off-site. For example, some municipalities have implemented landfill diversion programs in which residents and businesses separate food and other organic waste from non-organic waste. The resulting collections of organic waste, which are typically stored in bins or bags prior to transportation to municipal composting facilities, can generate foul odors, attract pests, and potentially present a source of disease or infection.

Further examples of the collection of organic waste include the provisional storage of soiled diapers before municipal collection, and the provisional storage of various types of medical waste prior to permanent disposal (e.g. via incineration). These collections can lead to offensive odors, and can also present infection risks.

The above problems with provisional on-site storage of waste, and particularly organic waste, can lead to reduced compliance with municipal waste programs (e.g. users may simply stop sorting organic refuse), medical facility procedures (e.g. workers may improperly dispose of certain waste, or increase the frequency with which collection receptacles are emptied, raising labour and material costs) and the like.

Various attempts have been made to mitigate the above issues using refrigeration. For example, U.S. Pat. No. 3,041,852 describes a waste receptacle whose interior is cooled via refrigeration coils within the receptacle's walls. The coils, in turn, are cooled by a heat pump that is motivated by an external source such as a household refrigerator. U.S. Pat. No. 3,161,030 also describes a waste receptacle with refrigeration coils contained within the inner walls and cooled by a vapor refrigeration cycle employing a compressor.

U.S. Pat. No. 3,650,120 describes a system acting as a hybrid trash compactor and freezer, that generates frozen pucks of refuse by means of wetting, compressing, and freezing (rather than simply cooling).

U.S. Pat. No. 5,181,393 describes a waste container that reduces the growth of bacteria by storing organic waste materials such as compost, medical waste, and diapers in a cool, low humidity environment. In this instance a UV light is also incorporated to further reduce bacterial growth. As with the previous examples, the refrigeration coils are contained within the inner walls of the volume.

U.S. Pat. No. 5,614,107 describes an industrial method of processing liquid sewage sludge by freezing the sludge in order to draw out the moisture, effectively freeze-drying the sludge to transform the sewage into a powder. U.S. Pat. No. 6,092,382 proposes dehydrating household waste by chilling the waste to temperatures just above freezing and in a separate compartment sharing the same atmosphere, accumulating liquid water on refrigeration coils by condensation and then allowing the condensate to run off to a collector where it is evaporated into the atmosphere of the home.

As a further example, German Utility Model No. DE20311066U1 describes a waste receptacle for organic waste or compost, whose interior is cooled by a thermoelectric device employing the Peltier effect.

The above-mentioned attempts to handle organic waste while reducing the incidence of odors, pest attraction and the like suffer from various drawbacks. For example, the arrangement of refrigeration coils may complicate the manufacture and maintenance of such devices, as well as reduce the cooling effectiveness of the devices. Some of the above-mentioned devices may also be difficult for users to load and unload.

SUMMARY

According to an aspect of the specification, an actively cooled waste receptacle is provided, comprising: an insulated container including (i) an inner wall defining a chamber having an opening for receiving the waste, and (ii) an outer wall surrounding the inner wall and joined to the inner wall at the opening; a cover configured to prevent access to the chamber via the opening in a closed position, and to allow access to the chamber via the opening in an open position; and a heat pump including an interior heat exchanger exposed to the chamber, the heat pump configured to cool the chamber by absorbing heat from air within the chamber via the interior heat exchanger, and transferring the heat outside the insulated container.

BRIEF DESCRIPTIONS OF THE DRAWINGS

Embodiments are described with reference to the following figures, in which.

DETAILED DESCRIPTION OF THE EMBODIMENTS

Figure 1:
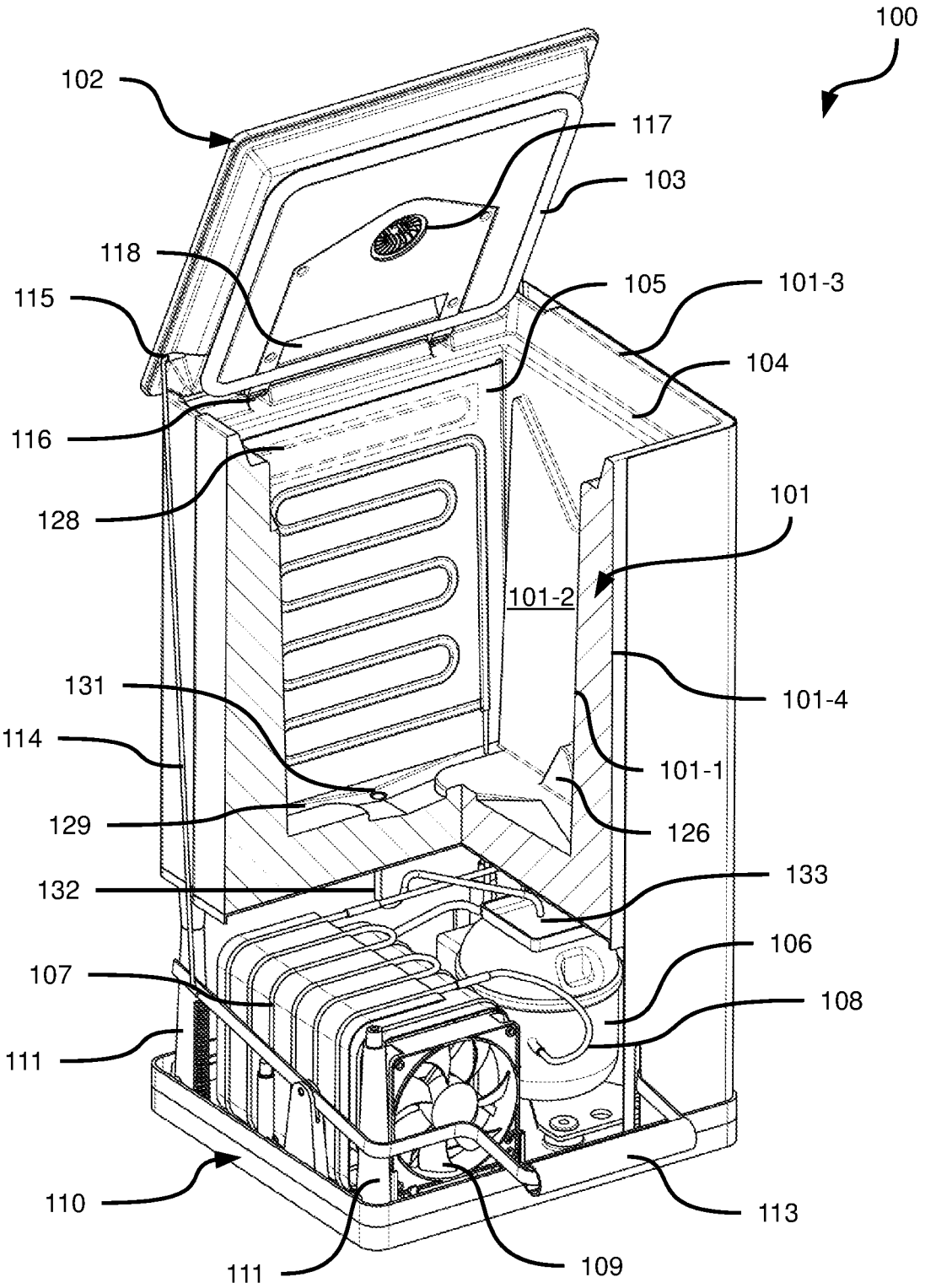
FIG. 1 depicts a front orthographic cutaway view of an actively cooled waste receptacle with a removable bin omitted, according to a non-limiting embodiment.
Figure 2:
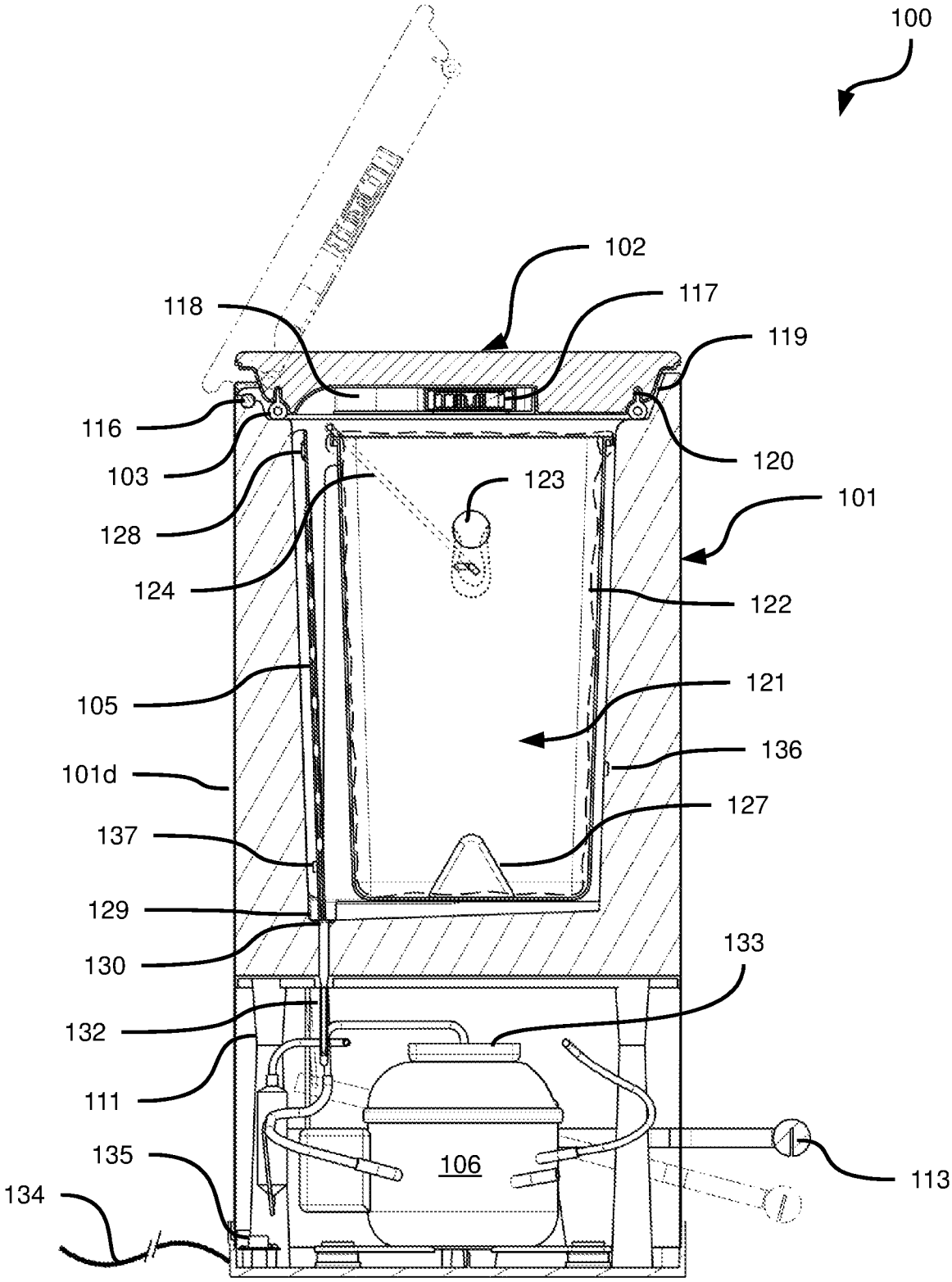
FIG. 2 depicts a side section view of the receptacle of FIG. 1, according to a non-limiting embodiment.
Figure 3:
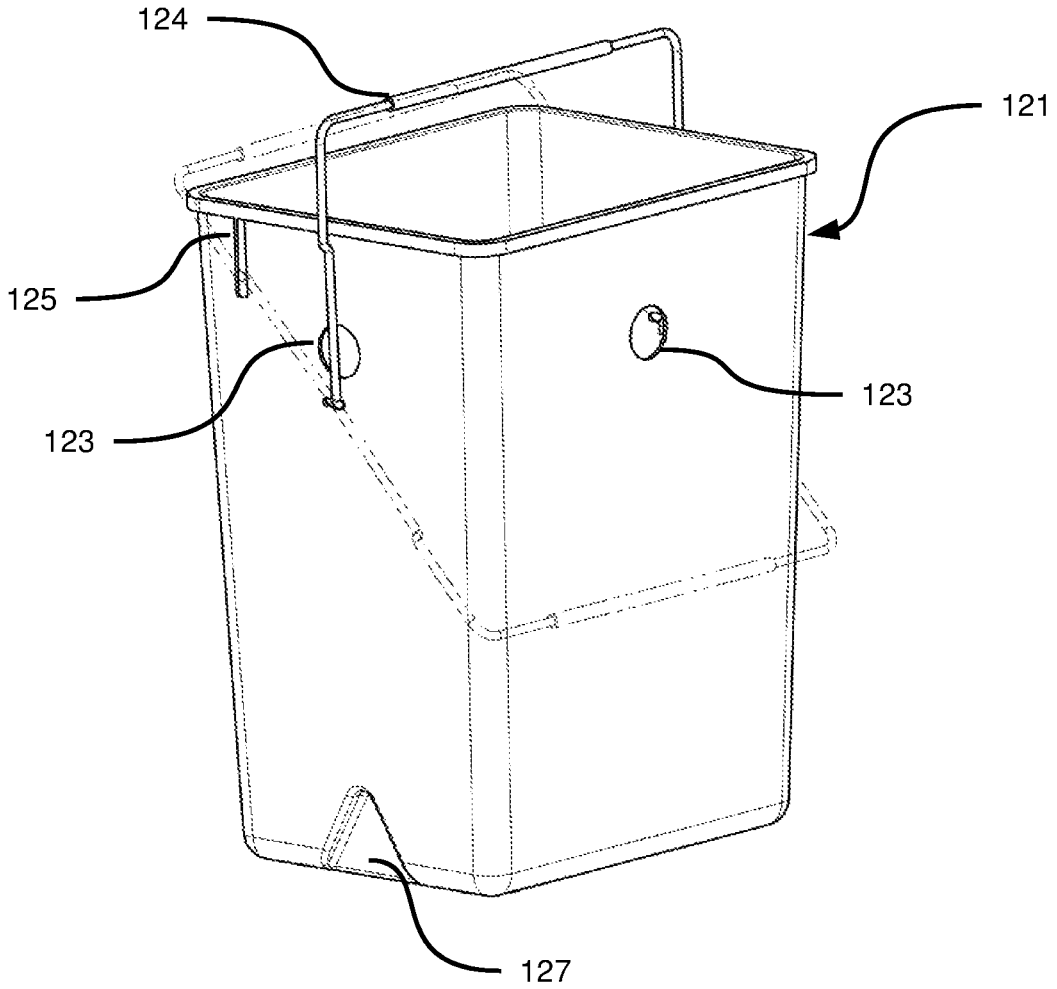
FIG. 3 depicts the removable bin of the receptacle of FIG. 1, according to a non-limiting embodiment.

FIGS. 1-3 depict an actively cooled waste receptacle 100 (also referred to simply as receptacle 100) according to a first embodiment. In the present embodiment, the receptacle 100 is a standalone freezer appliance comprising a heat pump (e.g. a vapor compression heat pump, thermoelectric heat pump, absorption heat pump or the like) and an insulated container 101. The insulated container 101 includes an inner wall 101-1 defining a chamber 101-2 having an opening 101-3 for receiving any of a variety of waste (e.g. organic waste). The insulated container 101 also includes an outer wall 101-4 surrounding the inner wall 101-1 and joined to the inner wall 101-1 at the opening 101-3. The nature of the inner and outer walls 101-1 and 101-4 is not particularly limited: the walls can be made of any suitable material, and can define a cavity therebetween containing insulating material. In other embodiments, the walls and the insulating material can be an integral component fabricated from a single material, and the walls 101-1 and 101-4 can simply be the inner and outer surfaces of that component.

The receptacle 100 also includes a cover, which in the present embodiment is an insulated lid 102, for sealing and enclosing the container 101 from the top (though as will be seen below, other orientations are also contemplated for the cover). The lid 102 is configured to prevent access to the chamber 101-2 via the opening 101-3 in a closed position, and to allow access to the chamber 101-2 via the opening 101-3 in an open position (shown in FIG. 1). In the present example, the lid 102 is movably coupled to the container 101, for example via a hinge. In other embodiments, the lid 102 can be detachable from the container 101 rather than being movable coupled to the container 101. The lid 102 has a gasket 103 to form a substantially airtight seal with an intermediate lip 104 formed by the inner wall 101-1 of the container 101.

The above-mentioned heat pump includes an interior heat exchanger, which in the present embodiment is an evaporator 105 (specifically, a roll-bond type evaporator, although other types of evaporators may also be employed) contained within the container 101 and exposed to the chamber 101-2 (that is, exposed directly to the air within the chamber 101-2 rather than being embedded between the inner and outer walls 101-1 and 101-4). Further, in the present embodiment, the evaporator 105 is supported by a mounting member (which may, for example, be a portion of the evaporator itself) within the chamber 101-2 spaced apart from the inner wall 101-1 (i.e. stood off from the rear wall of the container 101 as seen in FIG. 1). Thus, air within the chamber 101-2 can travel not only along the inner side of the evaporator 105 (that is, the side closest to the center of chamber 101-2), but also between the evaporator 105 and the nearest inner wall 101-1).

The interior heat exchanger (i.e. the evaporator 105, in the present embodiment) has a substantially planar configuration and is mounted substantially parallel to a surface of the inner wall 101-1. In particular, in the embodiment shown in FIG. 1, the evaporator is positioned substantially vertically (as seen when the receptacle 100 is in use).

The heat pump can have a variety of configurations. As noted above, in the present example, the heat pump is a vapor compression heat pump, and thus the evaporator 105 is connected to a compressor 106 and an exterior heat exchanger in the form of a condenser 107 via connecting refrigeration tubing 108 (completing the heat pump circuit) through the walls of the container 101. The exterior heat exchanger exhausts heat absorbed by the interior heat exchanger from the chamber 101-2. More specifically, in the present embodiment a refrigerant fluid is metered by an expansion valve or capillary (not shown) into the evaporator 105, such that the fluid expands into a gas in the evaporator 105 and absorbs heat from the chamber 101-2. The fluid then travels to the compressor 106 and is compressed before travelling through the condenser 107, which removes heat from the fluid before the fluid returns to the evaporator 105 via the expansion valve or capillary.

The embodiment shown in FIG. 1 is integrated vertically. In other words, the compressor 106, the condenser 107, and a condenser fan 109 are contained below the container 101, within a base 110 that forms the bottom of the receptacle 100 when in use. A plurality of pylons 111 connect the base 110 to the container 101. The lid 102 rests on top of the container 101. A shell 112 can be provided that fits over the base 110 and the container 101 to form the exterior of the receptacle 100, providing protection to the internal components of the receptacle 100.

The receptacle 100 can include a lifting mechanism to lift the lid 102 (i.e. to move the lid 102 from the closed position to the open position) and permit access to the chamber 101-2. The lifting mechanism in the embodiment of FIG. 1 is hands-free, including a pedal 113 connected to the lid 102 via a mechanical linkage 114 to engage with the lid 102 at an end 115 and actuate the lid 102 open and closed by rotating the lid 102 about a hinge 116. Alternatively, the means of hands free actuation can be a solenoid and sensor or contact (e.g. a button, switch, proximity sensor or the like) that may also be paired with tension springs to assist in actuation. The hinge 116, in the present embodiment, is affixed to the top rear of the shell 112 and/or the container 101.

The receptacle 100 can also include a fan mounted within the chamber 101-2 and configured to circulate the air within the chamber 101-2. In the present example, a fan 117 is embedded in an inner surface of the lid 102 (that is, a surface facing the chamber 101-2 when the lid 102 is closed). In other embodiments, as will be discussed in greater detail below, the fan 117 can be embedded in the inner wall 101-1. The fan 117 preferably serves to cause air in the chamber 101-2 to flow directly over the evaporator 105. In the present embodiment, the fan 117 is enabled to direct air over the evaporator 105 by way of a duct 118 (most clearly seen in FIG. 2) having an inlet and an outlet. The fan 117 is placed to draw air into the duct 118 via the inlet, and expel the air from the outlet. As seen in FIG. 2, the outlet is disposed above the evaporator 105, such that air returned to the chamber 101-2 from the duct 118 flows along the evaporator 105.

In other embodiments, the duct 118 need not be embedded within the lid 102 or the walls of the container 101. Instead, for example, the duct can be mounted on the inner wall 101-1 (and therefore protrude into the chamber 101-2).

In the present embodiment, the interface between the lid 102 and the container 101 is shaped so that a portion (in the present example, that portion representing a majority of the volume of the lid 102) of the lid 102 is nested within the upper walls of the container 101. This is achieved by flaring the inner wall 101-1 outwards adjacent to the opening 101-3, and tapering the bottom of the lid 102 inwards, creating a tapered lid-volume interface. This creates a tapered baffle 119 (see FIG. 2) to deter air flow between the chamber 101-2 and the exterior of receptacle 100, and to further enhance the seal of the lid 102 over the chamber 101-2 by reducing or preventing drafts and air leakage. A slot 120 (see FIG. 2) can be provided around an edge of the lid 102 as a provision for attaching the gasket 103. This nested configuration also provides an aesthetically pleasing appearance, reducing the visibility of the lid 102 to make it appear thin when closed, and hiding the gasket 103 from view.

The receptacle 100 can also include a removable bin 121 (see FIGS. 2 and 3) having a loaded position within the chamber 101-2 for receiving and holding waste, and an unloaded position removed from the chamber 101-2 (e.g. for emptying waste). The removable bin 121 can hold a removable bag or liner 122 (see FIG. 2). The removable bin 121 can include a retainer for gripping a portion of the bag 122, such as one or more holes or clips. In the present embodiment, the retainer is provided by matching bag/liner retention holes 123. In the embodiment shown in FIG. 3, holes 123 are provided on each of the four sides of the bin 121. However, in other embodiments a variety of other hole arrangements can be employed. In operation, a portion of the bag 122 can be inserted into and retained by each hole 123 (see FIG. 2) to aid in conforming the bag 122 to the shape of the bin 121. The bin 121 can be sized and shaped to accommodate common plastic grocery bags. The bin 121, in some embodiments, can also include perforations or texturing on an inner surface thereof to reduce adhesion of the bag to the bin 121.

To aid in the loading and unloading of the bin 121 from the chamber 101-2, the bin 121 can include a handle 124 with opposing ends affixed to opposing sides of the bin 121. The handle 124 can be rotatable so as to permit raising the handle 124 to remove the bin 121 from the receptacle 100, and lowering the handle 124 upon placement of the bin 121 within the chamber 101-2. The bin 121 can include a handle stop 125 (see FIG. 3) extending outwards from a wall thereof, so that the handle 124 rests in the upright position but does not obstruct the opening of the bin 121. The handle 124, in the present embodiment, is affixed to the bin 121 below an opposing pair of bag/liner retention holes 123. In other embodiments, the handle 124 can be connected to the bin 121 in any other suitable way, or can simply be omitted.

The container 101 can include a guide structure within the chamber 101-2. For example, as seen in FIG. 1, the inner wall 101-1 includes a protrusion 126 (two protrusions are provided in this embodiment, on opposite sides of chamber 101-2) extending into the chamber 101-2. The bin 121 has a complementary indentation 127 (again, in the present embodiment two indentations 127 are provided) that matches the protrusion 126 in shape and engages with the protrusion 126 for aligning the removable bin 121 within the chamber 101-2. The inner wall 101*s* is shaped and sized to facilitates air flow around the sides and underneath the bin 121 to aid convective airflow while also providing a flat surface for the bin 121 to rest (see indentations in the bottom of the inner wall 101-1 shown in FIG. 1).

The receptacle 100 also includes a defrosting mechanism removing accumulated frost build up, which in the present embodiment is a heating element 128 (also referred to as a defrost pad) affixed to the evaporator 105. Defrost pad 128 can be an electrically powered resistive strip, and serves to periodically raise the temperature of the evaporator 105 above the freezing point of water (in embodiments in which the temperature of the chamber 101-2 is brought below freezing). When the evaporator 105 is warmed by defrost pad 128, any frost built up on the evaporator 105 melts and runs off of the evaporator 105.

Formed into the bottom of the container 101 wall is a drainage trough 129 (most readily visible in FIG. 2). In some embodiments, additional defrost pads can also be provided. For example, a drainage trough defrost pad 130 is affixed to wall of the drainage trough 129. At the bottom of the trough 129 is a drain 131 extending from a drain inlet in the inner wall 101-1, through the container 101 to a drain outlet in the outer wall 101-4. The drain 131 directs defrost runoff fluid from the evaporator 105 (and from the chamber 101-2 more generally) to the exterior of the container 101, in the present example via a P-trap 132 that runs into a drain pan 133. In the present embodiment, the drain pan 133 is mounted over the compressor 106. In other embodiments, however, the drain pan 133 can be placed in any other suitable location. The drain pan 133 may also be omitted (for example, the drain 131 may direct water into a wastewater line connected to a municipal network).

The receptacle 100 is powered by any suitable electrical power source, such as a standard home outlet through a power cord 134 (see FIG. 2). Other power sources are also contemplated, such as batteries, solar panels and the like. In addition, it will be apparent to those skilled in the art that some embodiments (e.g. those employing absorption-based heat pumps) may not require electrical power. The receptacle is controlled via an electronic control unit 135, also referred to as a controller, (e.g. a printed circuit board or other electronic device implementing any one of, or any suitable combination of thermostats, refrigeration timers and defrost timers). The control unit 135 samples temperature from inside the container 101 using a primary temperature or moisture sensor 136 to determine when to activate the heat pump. A defrost temperature sensor 137 may be located on the evaporator 105 which controls the defrost cycle. For example, the controller 135 can be configured to automatically enable the defrost pads 128 and 130 when the temperature of the evaporator (as measured via the sensor 137) rises above a predetermined threshold). Similarly, the controller 135 can be configured to automatically enable the heat pump to cool the chamber 101-2 when the temperature of the chamber 101-2 rises above another predetermined threshold (e.g. zero Celsius).

In operation, the receptacle 100 is provided with electrical power (if required, as noted above), for instance through the power cord 134. The control unit 135 samples the temperature of the chamber 101-2 through the primary temperature sensor 136 and initiates operation of the compressor 106. As a result, the evaporator 105 will become chilled, in the present embodiment to sub-zero (Celsius) temperatures. At the same time, the controller 135 is configured to enable the interior fan 117 to begin circulating air in the chamber 101-2, including passing air over the evaporator 105 via the duct 118. This will reduce the temperature of the air (and subsequently the waste) within the volume 101 to below the freezing point of water.

Independently of the above, a user may remove the bin 121 from the container 101 and affix a bag 122 into the bin 121. This is accomplished by placing the bag 122 in the bin 121 and then forming the opening of the bag 122 around the top edges of the bin 121. The bag 122 is then retained to this shape by inserting portions of the bag (e.g. the handles of a grocery bag) into the retention holes 123. This is accomplished by rotating the handle 124 down and away from the retention holes 123 (as shown in dashed lines in FIG. 3) and then retaining the portions of the top edges of the bag 122, pulling the top edges taut around the outer edge of the bin 121. The user may then rotate the handle 124 up again and deposit the bin 121 back into the container 101 via the opening 101-3. In doing so, the protrusions 126 formed on the inner wall 101-1 of the container 101 serve to align the bin 121 by engaging with the indentations 127 formed into the bin 121. The engagement between the above-mentioned guide structures seats the bin 121 within the container 101 consistently, ensuring proper air flow within the volume 101.

The interior fan 117 reduces the incidence of temperature gradients within the chamber 101-2 by actively circulating air throughout the chamber 101-2.

The user may open the lid 102 by depressing the pedal 113, which pivots the lid 102 about the hinge 116 via the mechanical linkage 114. Alternatively, the user may manually lift or remove the lid 102. The user may then deposit waste into the bag 122 contained within the bin 121 and then release the pedal 113 to close the lid 102 (or manually replace the lid 102, in embodiments where the lid 102 is manually operated).

With waste contained within the bag 122, inside the bin 121 in the loaded position in the container 101, the cooling of the waste, preferably to temperatures below freezing, reduces or eliminates decomposition and the emission of foul odors. Further, a process of sublimation and deposition may occur in the chamber 101-2, in which moisture from the waste is drawn into the cool, dry air in the chamber 101-2 and deposited on the colder surface of the evaporator 105. Periodic activation of the defrost pads 128 and 130 by the control unit 135 melts the frost deposited on the evaporator 105 into water, which runs off into the drainage trough 129. The water then exits through the drain 131 at the bottom of the trough, through the P-trap 132 and into the drain pan 133. As noted earlier, in the present embodiment, the drain pan 133 is located on the compressor 106, where the water evaporates into the atmosphere aided by the waste thermal energy from the compressor 106.

When the bin 121 is full, the user may remove the bin 121 from the container 101 via the opening 101-3 and remove the bag 122, now containing frozen waste, in the opposite order of installation (as detailed above) and then replace the bag 122 with a new one and place the bin 121 back into the container 101 for further waste collection.

The embodiment may also be operated without the bin 121 by placing a bag 122 directly in the chamber 101-2. In some embodiments, the bag 122 may also be omitted, and waste (such as soiled diapers) may be placed directly into the chamber 101-2. Such usage can increase the useable volume for waste within the chamber 101-2, but is not presently preferred, due to the potential for reduced air flow within the chamber 101-2 and the potential for soiling of the evaporator 105 and the inner wall 101-1.

Figure 4:
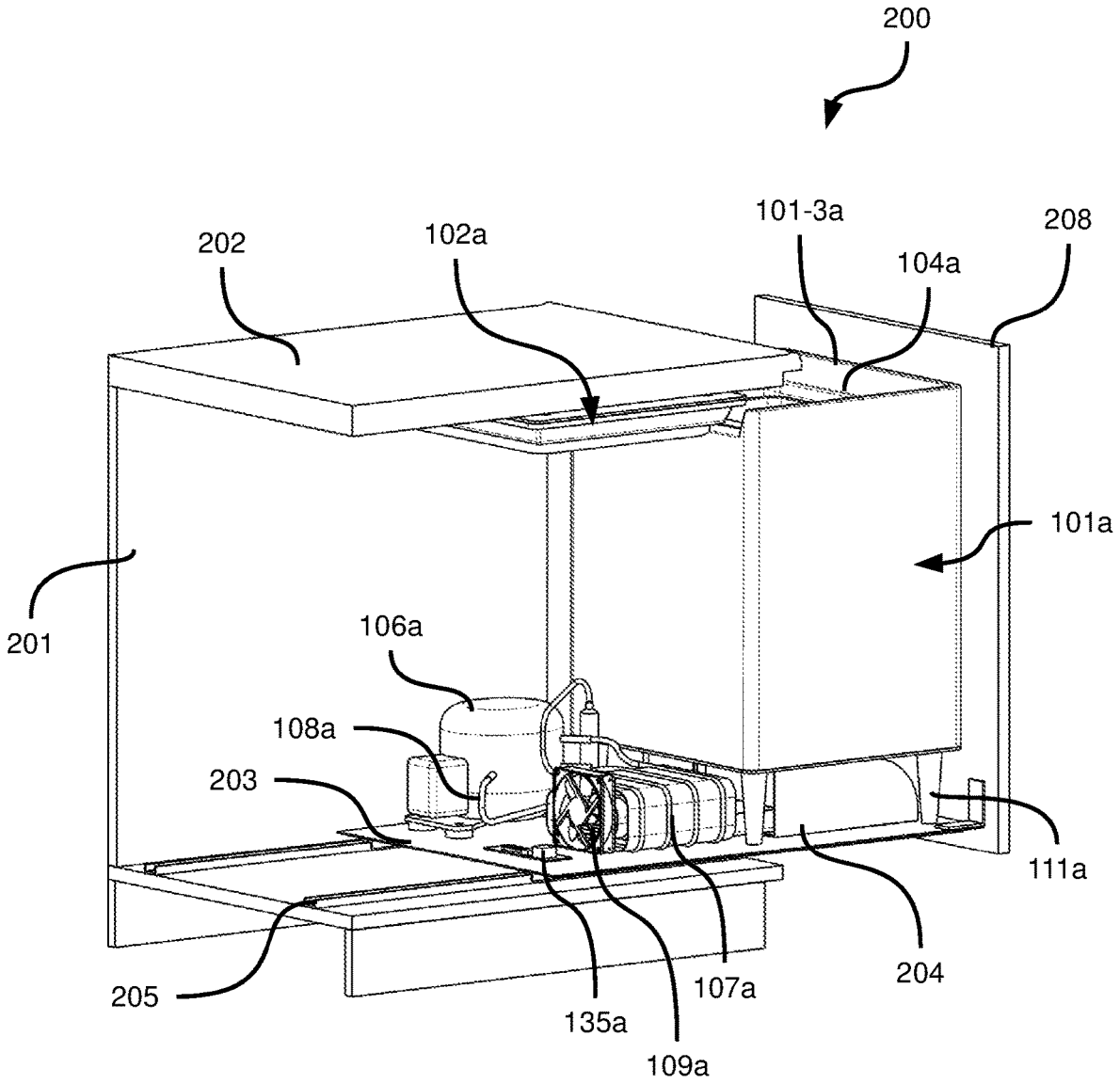
FIG. 4 depicts a rear orthographic view of an actively cooled waste receptacle in an open position, according to another non-limiting embodiment.
Figure 5:
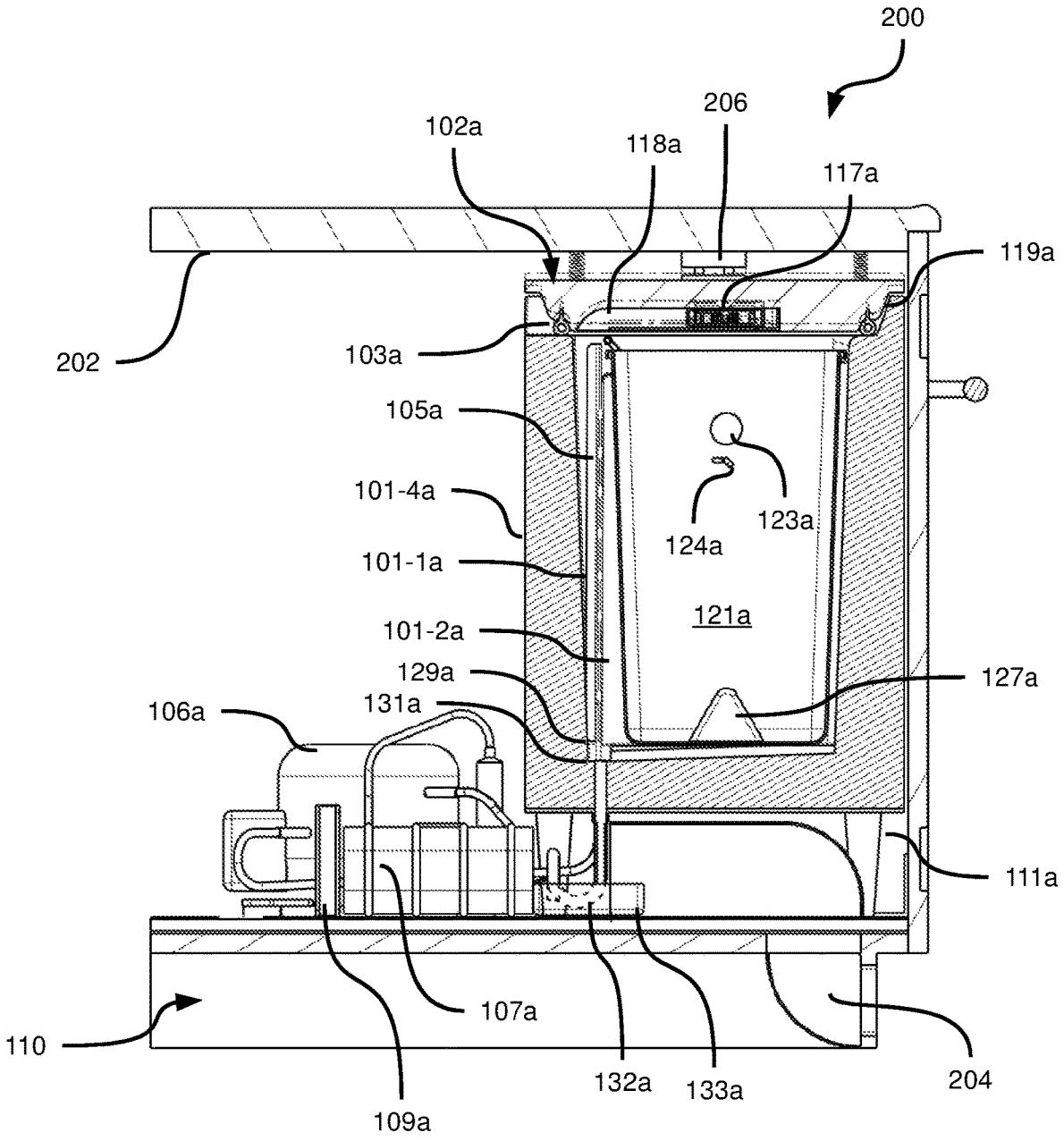
FIG. 5 depicts a side partial section view of the receptacle of FIG. 4 in a closed position, according to another non-limiting embodiment.
Figure 6:
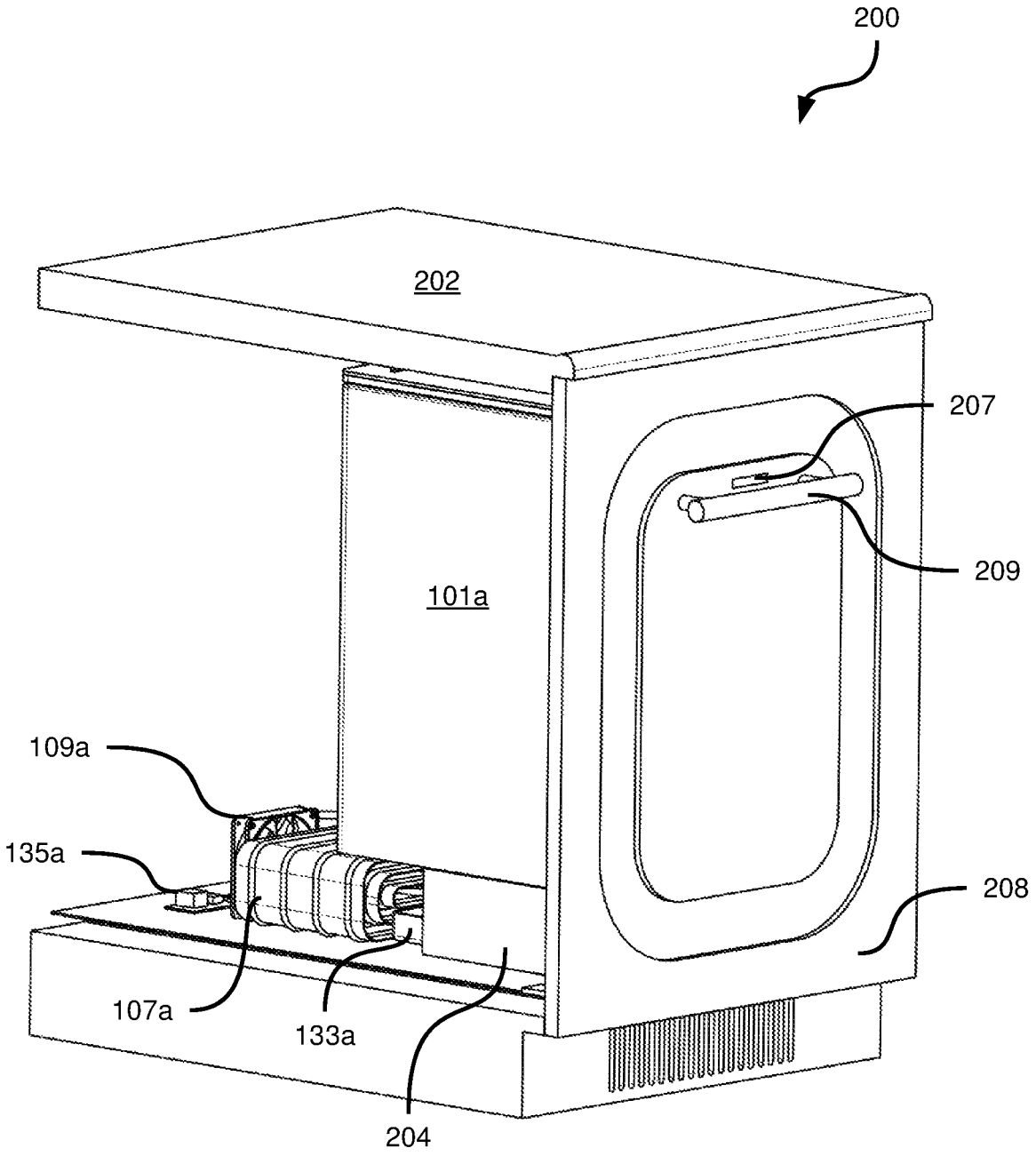
FIG. 6 depicts a front orthographic view of the receptacle of FIG. 4 in the closed position, according to another non-limiting embodiment.

Referring now to FIGS. 4-6, an actively cooled waste receptacle 200 according to another embodiment is illustrated. Components of the receptacle 200 similar to corresponding components of the receptacle 100 are numbered with the same reference numerals as introduced above in connection with the receptacle 100, but with the suffix "a".

Thus, the receptacle 200 includes a container 101*a* including an inner wall 101-1*a* defining a chamber 101-2*a* with an opening 101-3*a* and surrounded by an outer wall 101-4*a* (and joined to the outer wall 101-4*a* at the opening 101-3*a*). The opening 101-3*a* can be closed by a lid 102*a* having a gasket 103*a* that engages with an intermediate lip 104*a*. In addition, the lid 102*a* and the inner wall 101-1*a* are tapered near the opening 101-3*a* so as to provide a baffle 119*a*. The container 101*a* is supported by pylons 111*a*, and contains an interior heat exchanger 105*a*. In the present embodiment, the interior heat exchanger is an evaporator, and is a component of a heat pump including a compressor 106*a* and a condenser 107*a* connected to the evaporator 105*a* by fluid lines 108*a* and cooled by a condenser fan 109*a*.

The receptacle 200 can include a fan 117*a* mounted within the chamber 101-2*a*, as well as a duct 118*a* for directing air onto the evaporator 105*a*. The evaporator 105*a* can include a defrost pad (not shown), and the chamber 101-2*a* includes a drain trough 129*a* (which can also include a defrost pad, not shown) for directing defrost runoff fluid to a drain 131*a* for removal of the fluid from the chamber 101-2*a* and collection in drain pan 133*a* via a p-trap 132*a*.

A controller 135*a* can monitor chamber temperature via a sensor (not shown), and can also monitor the temperature of the evaporator 105*a* via another sensor (not shown). Based on the monitored state of the receptacle 200, the controller 135*a* can automatically enable and disable the above-mentioned heat pump and defrost pads.

A bin 121*a* having bag retention holes 123*a* and a handle 124*a* can be loaded into the chamber 101-2*a* to collect waste within a bag (not shown) supported in the bin 121*a*. The bin 121*a* can include indentations 127*a* for engaging with complementary protrusions 126*a* formed on the inner wall 101-1*a* of the container 101*a* to align the bin 121*a*.

The receptacle 200 is configured as a freezer appliance integrated into a cabinet 201, for example beneath a countertop 202. The receptacle 200 may be integrated vertically, as with the receptacle 100. Alternatively, as illustrated in FIG. 4, the heat pump components can be positioned beside or behind the container 101*a*.

The compressor 106*a*, condenser 107*a*, and condenser fan 109*a* are mounted to a movable base 203. A thermal exhaust duct 204 is provided to the outside of the cabinet 201 to allow heat to be expelled by the condenser 107*a*. The base 203 is mounted on rails 205 that permit the base 203 to slide in and out of the cabinet 201. The container 101*a*, as noted above, is supported by the pylons 111*a* on the base 203, but in other embodiments, the container 101*a* may sit directly on the base 203. The configuration of supports for the container 101*a* may be dependent on the depth of the cabinet 201. The sliding motion of the base 203 may be passive and performed by the user, or active and performed via an electromechanical mechanism (e.g. a linear actuator activated by a switch, proximity sensor or the like).

Alternatively, the base 203 may be linked to the cabinet 201 by a hinge and pivot outward, also actuated by the user or performed via electromechanical means. In further variations, the base 203 may be linked to the cabinet 201 by both sliding rails 205 and a hinge so as to protrude and then pivot.

In the present embodiment, the lid 102*a* is retracted upwards (towards the countertop 202 and away from the opening 101-3*a*) by a retractor 206, such as a solenoid actuator, that is activated by a switch, such as a proximity sensor 207 (see FIG. 6). The retractor 206 acts to lift the lid 102*a* slightly to allow the gasket 103*a* to disengage from the intermediate lip 104*a* of the container 101*a*, allowing the container 101*a* to slide out from the cabinet 201 unimpeded. Alternatively, mechanical linkages (such as sliding cams and push rods) can be used to lift the lid 102*a* with the motion of the base 203.

Alternatively, the lid 102*a* may be accessible via a cutout (not shown) in the cabinet countertop 202, in which case the lid 102*a* would need only pivot to open (similarly to the movement of the lid 102 described earlier in connection with FIGS. 1-3), revealing the chamber 101-2*a*.

The exterior of the receptacle 200 that faces the outside of the cabinet 201 can have a cover or shell, which may be arranged to be flush with adjacent cupboards when the receptacle 200 is closed. For example, the receptacle 200 can include a cabinet face 208 fixed to the front of the container 101*a* so as to blend in directly with the adjacent cabinets. The face 208 can include one or more of the above-mentioned sensor 207, a handle 209, or other structures permitting a user to open the receptacle 200 (e.g. a pedal, not shown).

Operation of the receptacle 200 is similar to that of the receptacle 100. Power is provided (if required, e.g. via an electrical cord, not shown), the heat pump chills the chamber 101-2*a*, the interior fan 117*a* circulates air and the bin 121*a* is lined with a bag 122*a*.

In contrast to the operation of the receptacle 100, however, to access the receptacle 200 for provisional waste storage, one or more of the sensor 207, handle 209, pedal or the like is activated. Such activation triggers the solenoid 206 (e.g. the controller 135*a* can detect the activation and cause the solenoid 206) to disengage the lid 102*a* from the opening 101-3*a* and permit the base 203 to slide out from the cupboard 201 to expose the container 101*a*. The user may then deposit waste within the bag contained within the bin 121*a* and then slide and/or pivot the container 101*a* back into the cabinet 201. Alternatively, the user may remove the bin 121*a* from the container 101*a* and place it on the countertop 202 for collection of waste, re-inserting the bin 121 when they are finished. Once the container 101*a* is contained within the cabinet 201, the lid 102*a* re-engages (e.g. the controller 135*a* can detect the re-insertion of the container 101*a* and cause the solenoid 206 to move the lid 102*a* to the closed position), sealing the opening 101-3*a*. Once waste is contained within the interior volume, the process of freezing, sublimation, and deposition as described above takes place to retard odors and reduce or eliminate bacteria growth and decomposition of the waste. As also described earlier, automatic defrost can be initiated periodically to keep the evaporator 105 free from excessive frost build-up.

Figure 7:
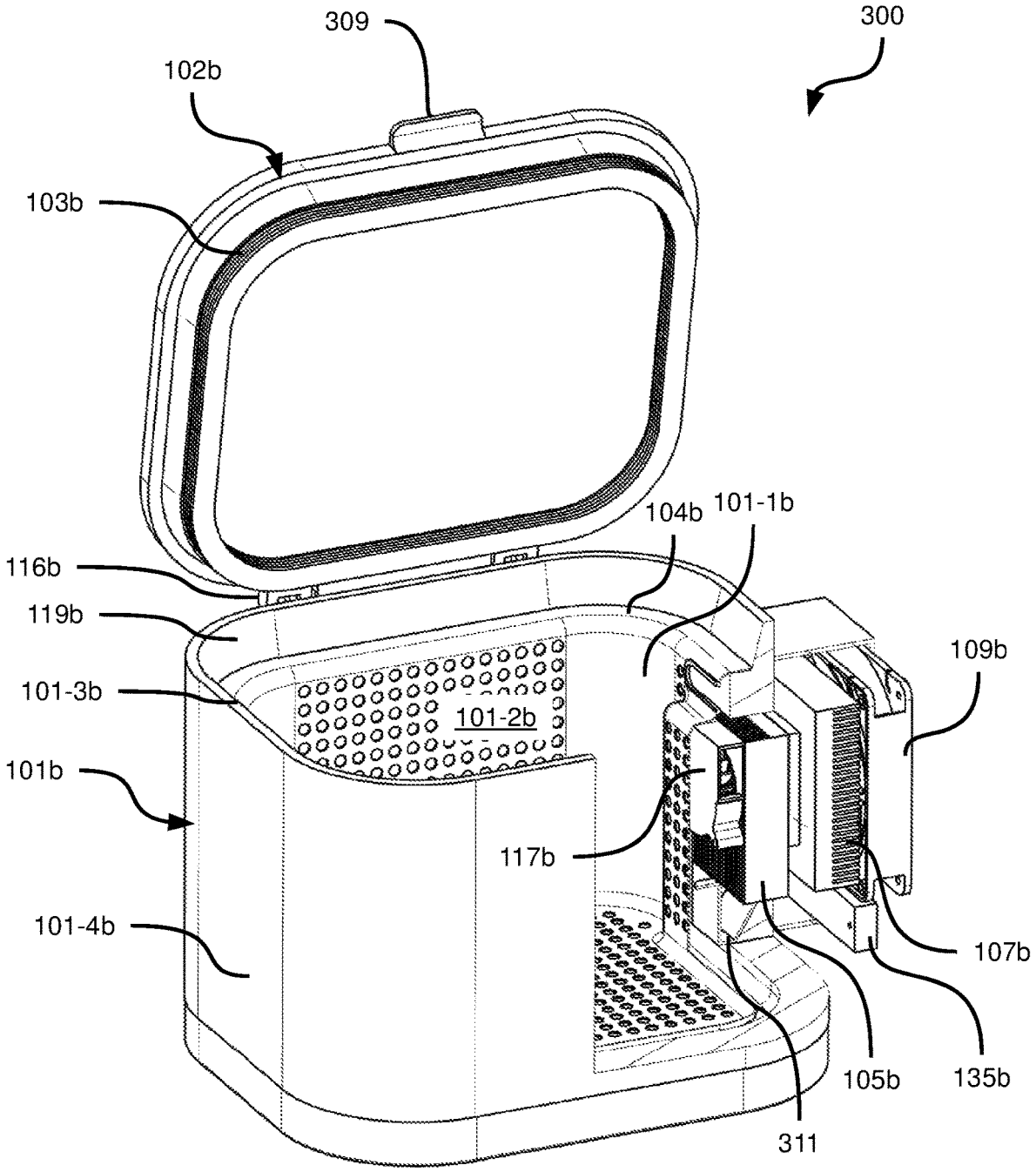
FIG. 7 depicts a front orthographic cutaway view of an actively cooled waste receptacle, according to a further non-limiting embodiment.
Figure 8:
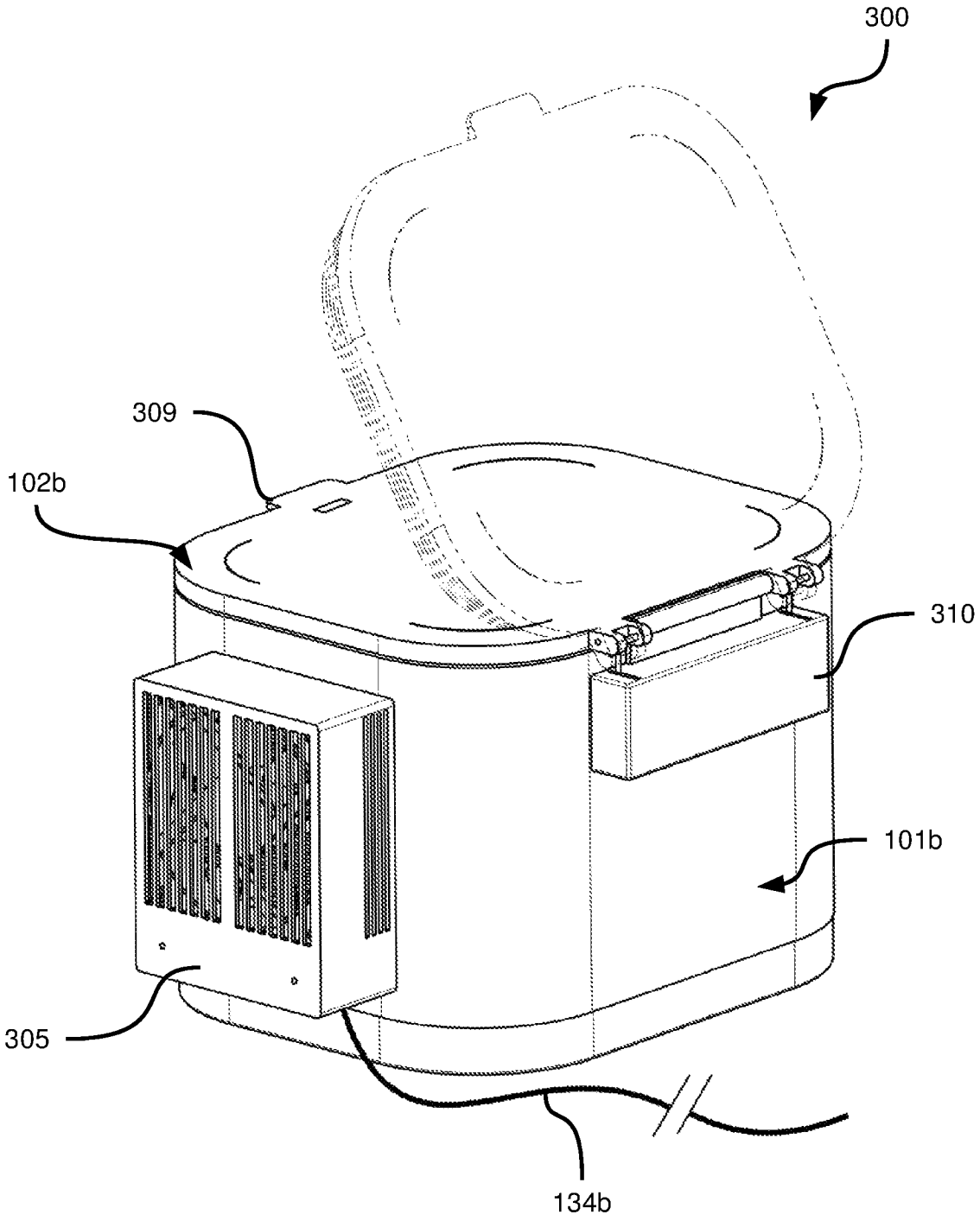
FIG. 8 depicts a rear orthographic view of the receptacle of FIG. 7, according to a further non-limiting embodiment.
Figure 9:
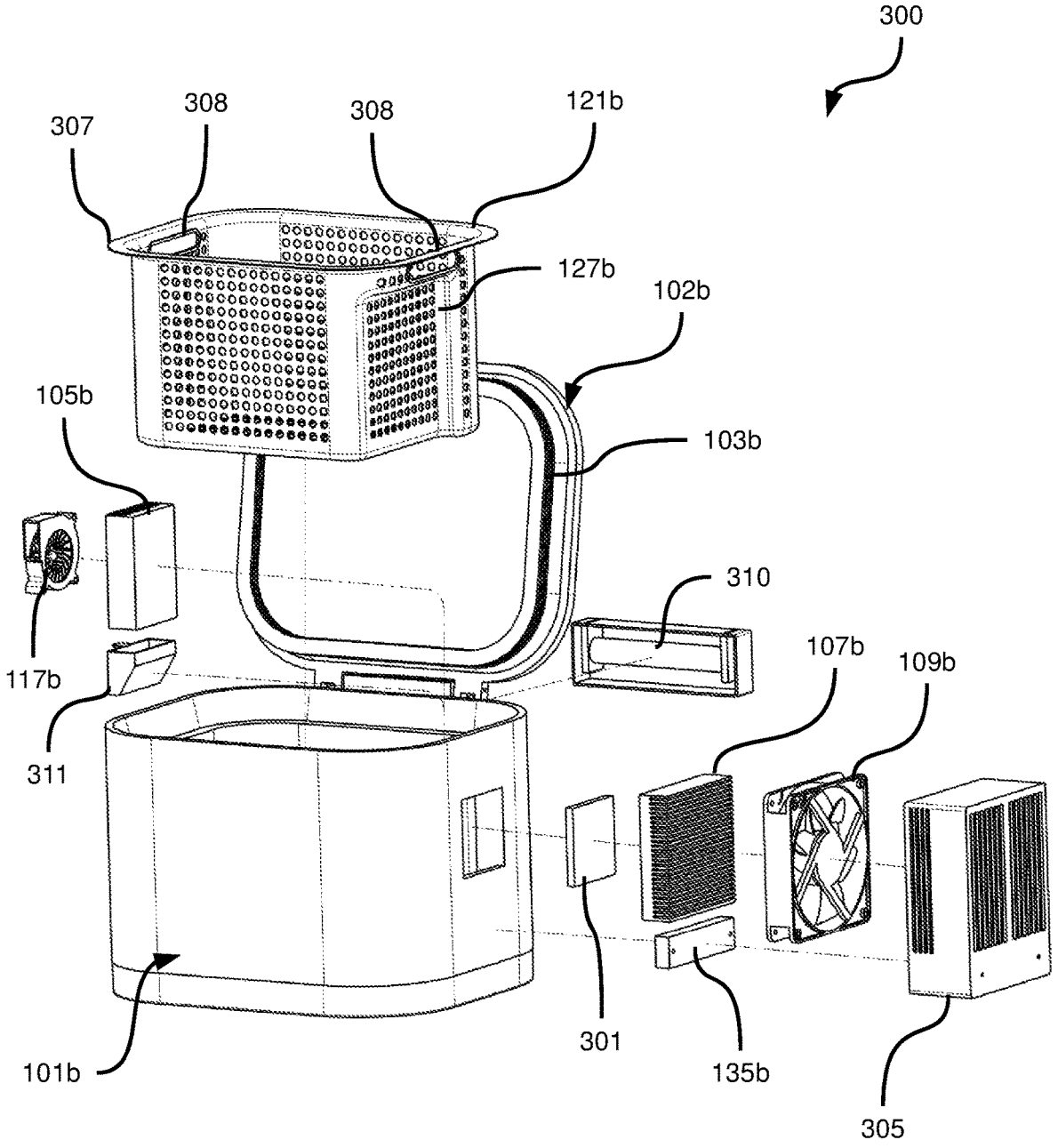
FIG. 9 depicts an exploded view of the receptacle of FIG. 7, according to a further non-limiting embodiment.

Referring now to FIGS. 7-9, an actively cooled waste receptacle 300 according to another embodiment is illustrated. Components of the receptacle 300 similar to corresponding components of the receptacle 100 are numbered with the same reference numerals as introduced above in connection with the receptacle 100, but with the suffix "b".

Thus, the receptacle 300 includes a container 101*b* including an inner wall 101-1*b* defining a chamber 101-2*b* with an opening 101-3*b* and surrounded by an outer wall 101-4*b* (and joined to the outer wall 101-4*b* at the opening 101-3*b*). The opening 101-3*b* can be closed by a lid 102*b* having a gasket 103*b* that engages with an intermediate lip 104*b*. The lid 102*b* moves between a closed position and an open position via a hinge 116*b*. In addition, the lid 102*b* and the inner wall 101-1*b* are tapered near the opening 101-3*b* so as to provide a baffle 119*b*. The container 101*b* contains an interior heat exchanger 105*b*, which is a component of a heat pump also including an exterior heat exchanger 107*b* cooled by a fan 109*b*. The receptacle 300 can include a fan 117*b* mounted within the chamber 101-2*b*, for directing air onto the heat exchanger 105*b*.

A controller 135*b* can monitor chamber temperature via a sensor (not shown), and can also monitor the temperature of the heat exchanger 105*b* via another sensor (not shown). Based on the monitored state of the receptacle 300, the controller 135*b* can automatically enable and disable refrigeration and defrosting functions of the receptacle 300. The controller 135*b* and other components can be powered via an electrical cord 134*b*, or any other suitable power source.

A bin 121*b* having bag retention holes 123*b* and a handle 124*b* can be loaded into the chamber 101-2*b* to collect waste within a bag (not shown) supported in the bin 121*b*. The bin 121*b* can include an indentation 127*b* for accommodating the heat exchanger 105*b* and fan 117*b*, and also for assisting in aligning the bin 121*b* within the chamber 101-2*b*.

The receptacle 300 is configured as a freezer appliance sized to fit on a counter (e.g. a kitchen counter). The interior heat exchanger 105*a* is a component of a thermoelectric (rather than vapor compression as in the previous embodiments) heat pump. The interior heat exchanger 105*b* is therefore implemented as a heatsink, and the heat pump also includes a thermoelectric device 301 employing the Peltier effect and having a hot side and a cold side. As will be apparent to those skilled in the art, the hot side and cold side of the device 301 are switchable, and the state of each side depends on whether the receptacle 300 is being refrigerated or defrosted, as described below.

The exterior heat exchanger 107*b* is also a heatsink, and can be covered by a protective cover 305. The heatsinks 105*b* and 107*b* are plate and fin heatsinks. In other embodiments, the heatsink 107*b* can be replaced by a liquid-cooled heatsink (e.g. having cooling block mounted on device 301 and circulating fluid therethrough, with the fluid being pumped through a radiator to dissipate heat collected by the fluid). In other embodiments, the heat pump of receptacle 300 may be replaced with a vapor compression heat pump such as those discussed earlier.

The bin 121*b* is provided in the form of a removable basket (and is therefore also referred to as a basket 121*b*). The basket is made from perforated or meshed sheet material (e.g. plastic, aluminum, or the like) to allow air to flow through, improving the cooling effect on the contents of the basket 121*b*. The basket 121*b* can be shaped to guide the convective airflow throughout the interior volume. Ducting or air-flow channels (not shown) may also be shaped into the walls of the lid 102*b* and basket 121*b*. This basket has a flat rim 307 that allows it to sit on the intermediate lip 104*b* of the container 101*b*. This suspends the remainder of the basket within the container 101*b*, allowing air to also circulate around and underneath the basket 121*b* and its contents. The basket 121*b* contains two cutout handles 308 to allow the removal of the basket 121*b* from the container 101*b*. A portion of a bag can be retained within these cutout handles 308 to conform the bag to the shape of the basket 121*b* (that is, the handles 308 can perform the same function as the retention holes 123 and 123*a* discussed earlier).

The lid 102*b* may be opened and closed via a tab 309. Alternatively, the lid 102*b* can be operated via a contact (a switch, button, or the like, not shown) or a proximity sensor (not shown) to actuate the lid 102*b* open by means of a solenoid 310 or other electromechanical means.

The receptacle 300 can include a removable drip cup 311 positioned below the interior heat exchanger 105*b* to collect defrosted water. The drip cup 311 made be made of silicon or other pliable material to allow ice to be easily removed therefrom.

The receptacle 300 is operated by first providing power (e.g. via cord 134*b*). The control unit 135*s* initiates the thermoelectric device 301. As a result, the interior heat exchanger 105*b* is cooled below a threshold temperature (preferably a sub-zero Celsius temperature). At the same time, the interior fan 117*b* begins circulating air throughout the chamber 101-2*b*. This will reduce the temperature of the air (and subsequently the waste) within the chamber 101-2*b* to below freezing. Independently of this, the user may remove the basket 121*b* and install a bag into the basket 121*b* and around the flat rim 307, inserting a portion of the bag through the cutout handles 308 to conform to the shape of the basket 306.

To access the receptacle 300, the user shall can lift the lid 102*b* via the tab 309 or the above-mentioned switch or proximity sensor. The user may then deposit waste within the bag and close the lid 102*b*. Once waste is contained within the chamber 101-2*b*, the process of freezing, sublimation, and deposition begins to retard odors and reduce or eliminate bacteria growth and decomposition of the waste as described earlier.

Periodically, the controller 135*b* can control the thermoelectric device 301 to switch the cold and hot sides thereof, to heat (rather than cool) the interior heat exchanger 105*b* for defrosting. This will cause the interior heat exchanger 105*b* to warm, melting any frost buildup into water. This water will drip into the drip cup 311 and may freeze into ice. This cup can be emptied periodically (e.g. by a user). When the basket 121*b* is full, the user may remove the bag containing frozen waste and then replace the bag with a new one.

Figure 10:
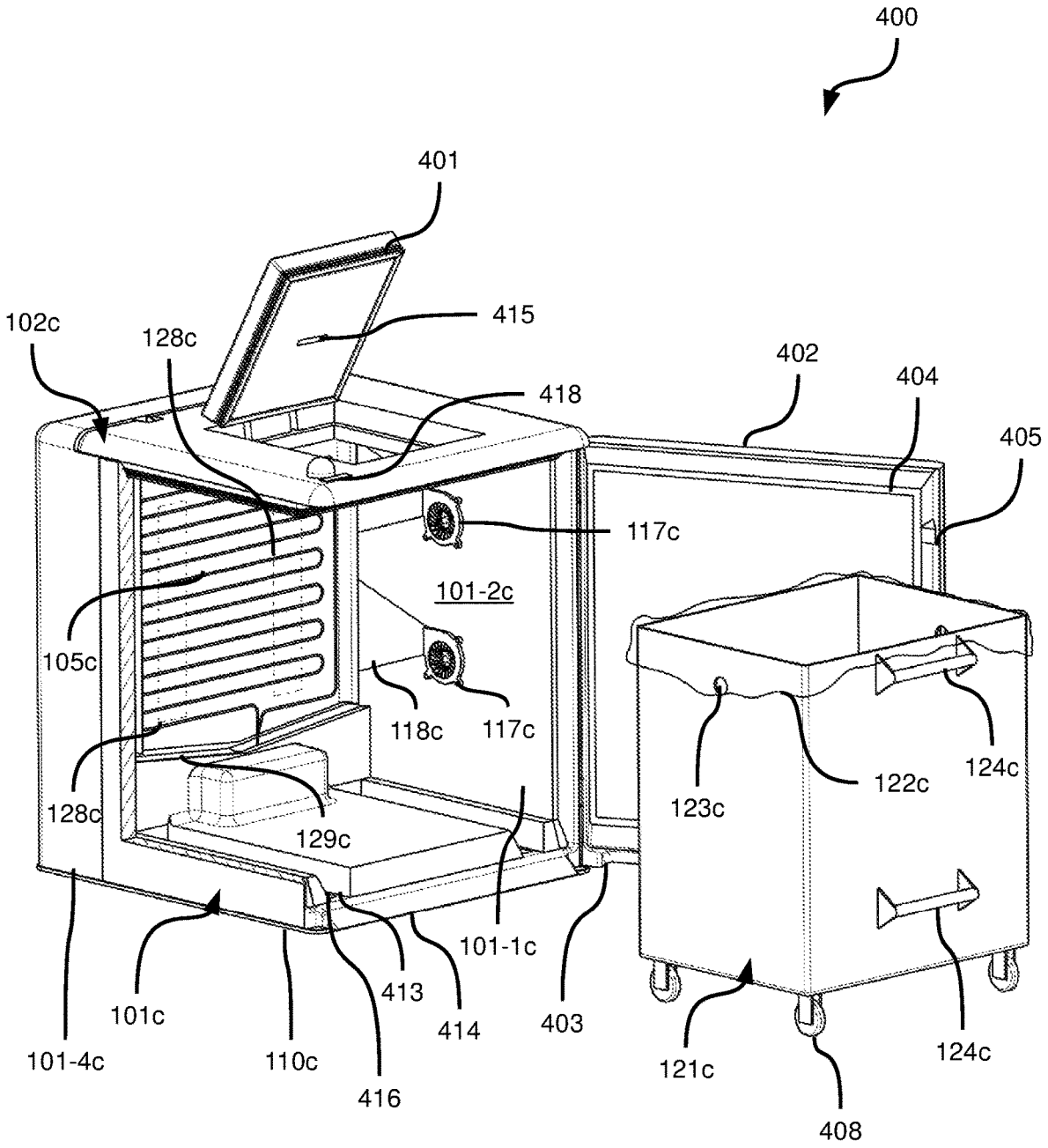
FIG. 10 depicts a front orthographic cutaway view of an actively cooled waste receptacle with a removable cart in an unloaded position, according to a still further non-limiting embodiment.
Figure 11A:
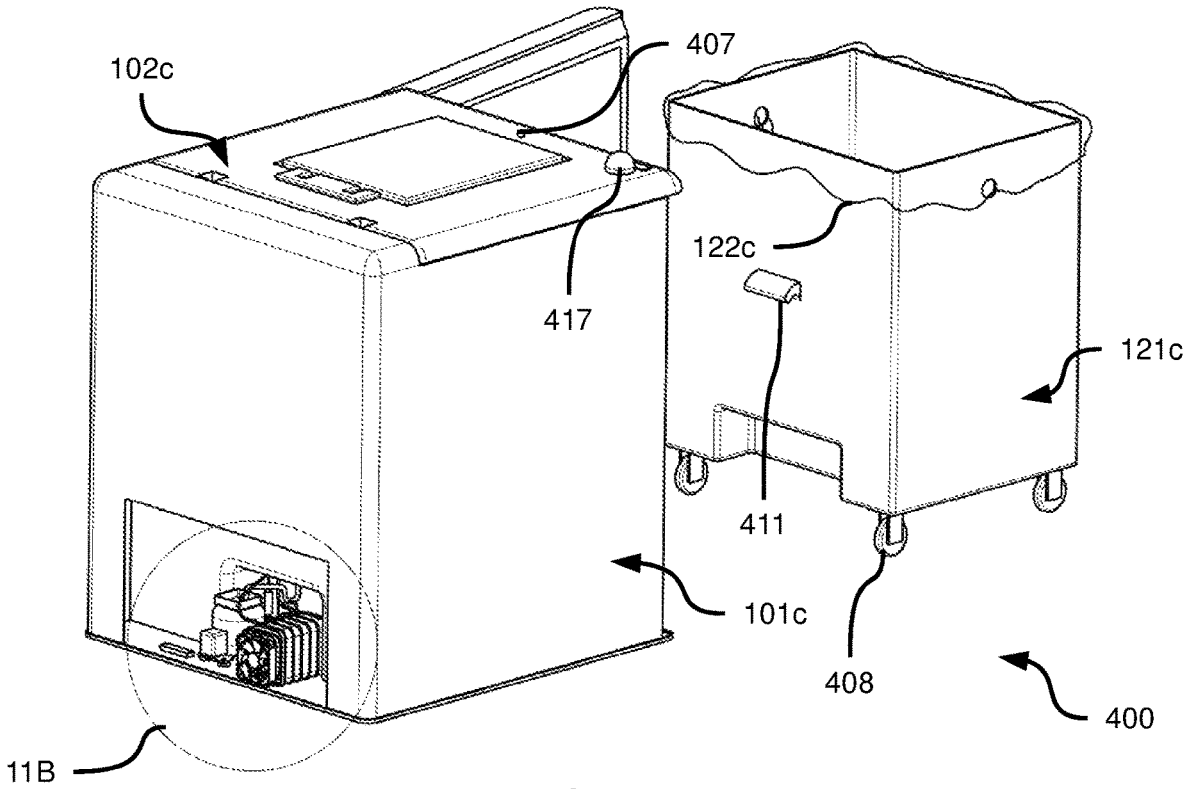
FIG. 11A depicts a rear view of the receptacle of FIG. 10, according to a still further non-limiting embodiment.
Figure 11B:
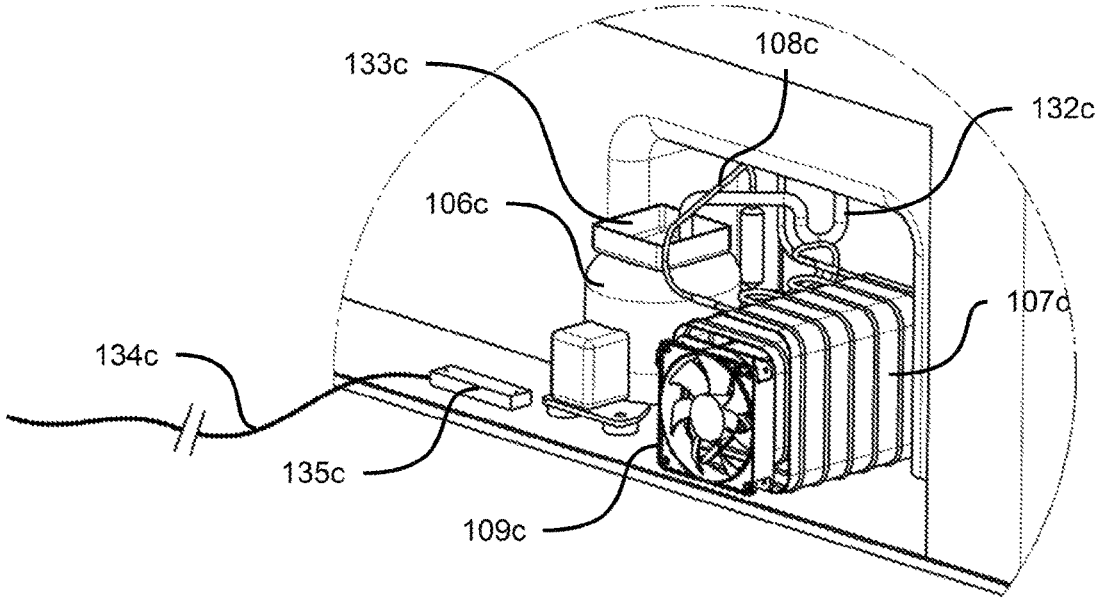
FIG. 11B depicts a detailed view of certain components of the receptacle as shown in FIG. 11A, according to a still further non-limiting embodiment.
Figure 12:
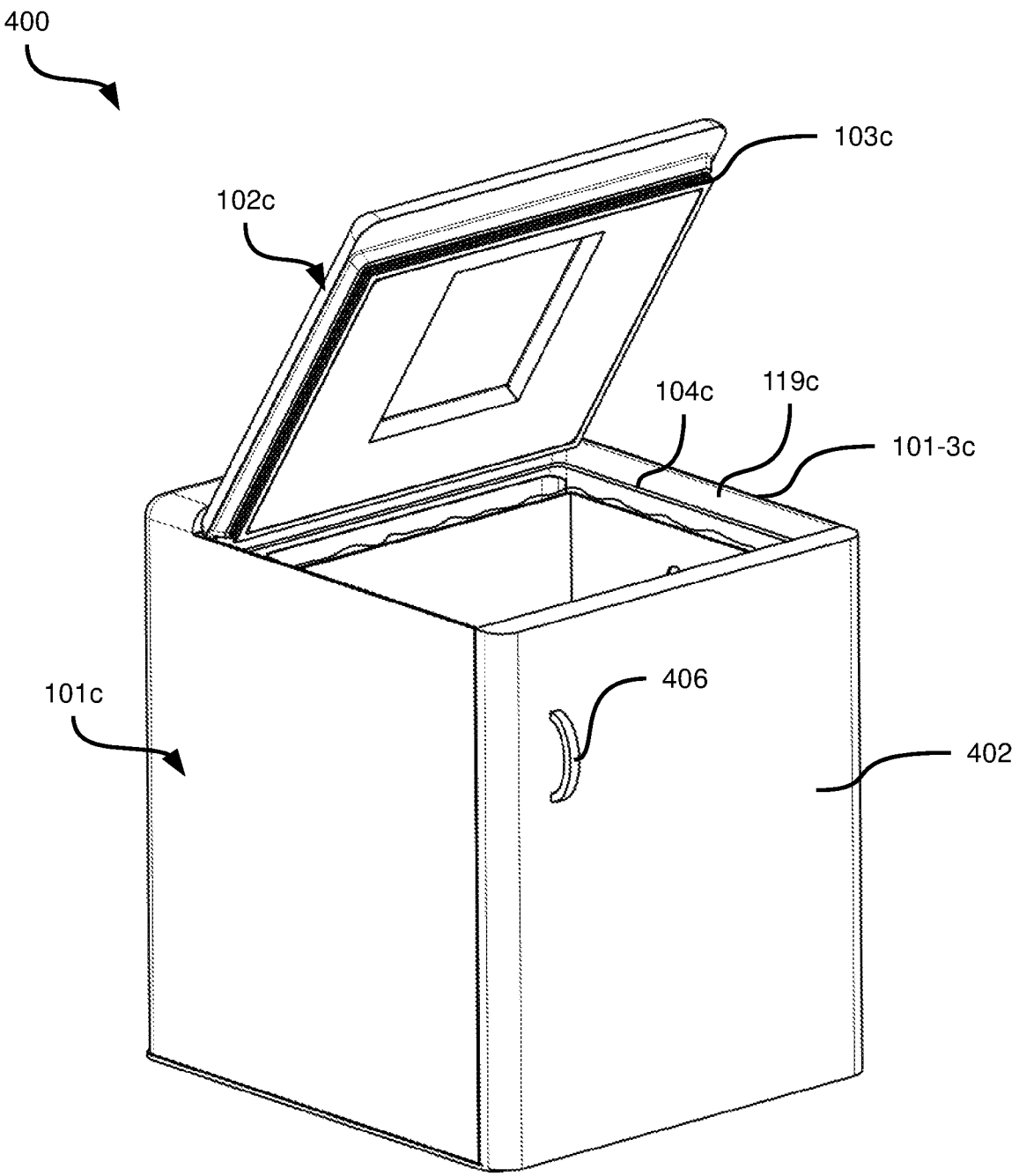
FIG. 12 depicts a front orthographic view of the receptacle of FIG. 10 with the removable cart in a loaded position, according to a still further non-limiting embodiment.

Referring now to FIGS. 10-12, an actively cooled waste receptacle 400 according to another embodiment is illustrated. Components of the receptacle 400 similar to corresponding components of the receptacle 100 are numbered with the same reference numerals as introduced above in connection with the receptacle 100, but with the suffix "c".

Thus, the receptacle 400 includes a container 101*c* including an inner wall 101-1*c* defining a chamber 101-2*c* with an opening 101-3*c* and surrounded by an outer wall 101-4*c* (and joined to the outer wall 101-4*c* at the opening 101-3*c*). The opening 101-3*c* can be closed by a lid 102*c* having a gasket 103*c* that engages with an intermediate lip 104*c*. In addition, the lid 102*c* and the inner wall 101-1*c* are tapered near the opening 101-3*c* so as to provide a baffle 119*c*. The container 101*c* contains an interior heat exchanger 105*c*. In the present embodiment, the interior heat exchanger is an evaporator, and is a component of a heat pump including a compressor 106*c* and a condenser 107*c* connected to the evaporator 105*c* by fluid lines 108*c* and cooled by a condenser fan 109*c*.

The receptacle 400 can include a fan 117*c* (the present embodiment includes two fans 117*c*) mounted within the chamber 101-2*c*, each pulling air into a duct 118*c* for directing air onto the evaporator 105*c*. The evaporator 105*c* can include a defrost pad 128*c* (two pads 128*c* are shown), and the chamber 101-2*c* includes a drain trough 129*c* (which can also include a defrost pad, not shown) for directing defrost runoff fluid to a drain for removal of the fluid from the chamber 101-2*c* and collection in drain pan 133*c* via a p-trap 132*c*.

A controller 135*c* can monitor chamber temperature via a sensor (not shown), and can also monitor the temperature of the evaporator 105*c* via another sensor (not shown). Based on the monitored state of the receptacle 400, the controller 135*c* can automatically enable and disable the above-mentioned heat pump and defrost pads 128*c*. A removable bin 121*c* having bag retention holes 123*c* and a handle 124*c* can be loaded into the chamber 101-2*c* to collect waste within a bag 122*c* supported in the bin 121*c*.

The receptacle 400 is configured as a standalone freezer appliance, sized appropriately for industrial or commercial use in that its overall dimensions are suitable for use in the garbage room of an apartment complex, in a hospital/nursing home setting or other facility requiring provisional waste storage.

The container 101*c* extends to a base 110*c* of the embodiment. Instead of being vertically integrated, the compressor 106*c*, condenser 107*c*, and other refrigeration components are located behind the container 101*c* (as seen in FIGS. 11A and 11B). The lid 102*c* of the receptacle 400 may include a deposit hatch 401 (including a gasket for sealing against the lid 102*c* and a tapered portion for forming a similar baffle to baffle 119*c*), activated through a proximity sensor 407, pedal, switch, tab or the like, and actuated via a solenoid or any other suitable mechanism. The lid 102*c* may employ a gas spring, spring or other biasing mechanism (not shown) to prop the lid 102*c* open.

The container 101*c* is accessible through a secondary opening in the form of an insulated door 402 on the front of the receptacle 400, which swings open on door hinges 403. The door 402 has a door gasket 404 to seal the container 101*c* from the front, and can taper similarly to the lid 102*c* to form a baffle similar to baffle 119*c* with container 101*c*. The door 402 may be kept shut by a door latch 405 or magnet and can include a door handle 406 or other mechanism for opening the door 402. The door 402 may be configured as a double door, pivoting off of either side of the container 101*c*. In such embodiments the double doors would latch to each other.

In contrast to the bins of the previously discussed embodiments, removable bin 121*c* is implemented as a wheeled cart (and is therefore also referred to as a cart 121*c*). The cart 121*c* has walls, an open top, and locomotive devices such as castor wheels 408 on the bottom. The shape of the cart 121*c* conforms to the shape of the chamber 101-2*c*, with some allowance for air circulation. As noted above, the cart 121*c* can also include a handle 124*c*. In the present embodiment, two handles 124*c* are provided that also act, in combination with a protruded fulcrum feature 411, as pivot grips 412 that allow the cart 121*c* to pivot about an axis to facilitate dumping the contents of the cart 121*c* into a larger collection bin or chute.

The receptacle 400 includes a guide structure for aligning the cart 121*c*. Rather than the protrusions 126 and indentations 127 mentioned earlier, however, the container 101*c* defines raceways 413 for receiving the caster wheels 408. Further, at the bottom of the container 101*c* along the interface with the door 402 is a ramp 414 to facilitate rolling the cart 121*c* into and out of the container 101*c*. The cart 121*c* itself may also have a door (not shown) to allow easy unloading of heavy bags full of waste.

The receptacle 400 can include a volume sensor (e.g. a fill level proximity sensor 415), a weight sensor (e.g. a load sensor disposed within one or both of the raceways 413), or a combination thereof, permitting the controller 135*c* to determine the current fill level and/or weight of the bin 121*c*. In other embodiments, the above-mentioned sensors may be mounted on the cart 121*c* itself. The receptacle 400 can include an output device for indicating how full the cart 121*c* is. The output device can include any one of, or any suitable combination of, a light 417, a display panel 418, a speaker for generating an audible signal, a (wired or wireless) network interface integrated with or otherwise connected to the controller 135*c*, and the like.

In the case of the above-mentioned network interface, the controller 135*c* may be connected to a network and communicate with a central hub through a smartphone or computer application whereby a multitude of other receptacles may be connected, all displaying their current level of waste.

The receptacle 400 is operated by first providing power to the unit. If the receptacle 400 is network enabled, it will connect to the network at this time and initiate a flow of information. The heat pump is then initiated (e.g. by the controller 135), cooling the container 101*c* to below a threshold (e.g. 0 degrees Celsius).

Independent of this, the user may unlatch the door 402 of the receptacle 400 and roll out the cart 121*c*, making use of the ramp 414 for this purpose. Once removed, the user may insert a bag 122*c* into the cart 121*c*, making use of the retention features 123*c* to conform the bag 122*c* to the internal shape of the cart 121*c*. The user may then roll the cart 121*c* back into the container 101*c* and close the door 402, using the latch 405 to retain it shut.

In regular usage, if the user has a small item to deposit (such as a diaper or small bag of refuse) they may use the deposit hatch 401 located within the lid 102*c* to quickly deposit an item. The user may actuate the deposit hatch 401 by use of the proximity sensor 407. This will activate the mechanism that opens the deposit hatch 401 to allow the user to deposit the refuse. The refuse will fall into the bag 122*c* contained within the cart 121*c*, within the volume 101.

If the user has a larger item to deposit, such as a soiled bedsheet, they may lift the lid 102*c* up entirely. This may be done by hand or using another pedal, proximity sensor, or contact. The lid 102*c* may be kept open by a gas spring cylinder, stopper, tension spring, or other mechanism to allow the user to deposit the larger item into the bag 122*c* within the cart 121*c*.

At such a time as the waste within the cart 407 meets a predetermined volume or weight, as determined by the fill level proximity sensor 415, load sensor 416, or other means, the controller 135*c* is configured to communicate that it is at capacity and requires emptying. Such communication may be achieved by activating any one or more of the indicator light 417, the display panel 418, or any other output devices that are present. If linked to a network, the controller 135*c* can communicate via the network (e.g. to a client computing device such as a smartphone) that the receptacle 400 requires emptying. Such network communication permits, in the case of a plurality of receptacles 400 deployed throughout a health care facility apartment complex or other site, a user to plan their route based on which receptacles 400 are indicating that they require emptying.

Once waste is contained within the chamber 101-2*c*, the process of freezing, sublimation, and deposition begins to reduce or eliminate odors and stall bacteria growth and decomposition of the waste as in the first embodiment. As described earlier, automatic defrosting can be initiated periodically by the controller 135*c* to keep the evaporator 105*c* free from excessive frost build-up.

Other variations to the above embodiments are also contemplated. For example, the use of thermoelectric devices or other refrigeration methods are interchangeable with the refrigeration means described above. Alternative means of defrost such as electrical impulse, ice phobic coatings, and vibrations, or other means yet devised can be employed. Alternative means of power such as photovoltaic and wind turbines may be employed. Temperatures may be adjusted to above the freezing point of water for some applications.

Changes in size, shape, and appearance to accommodate different commercial applications such as restaurants, food trucks, nursing homes, hospitals, apartment complexes, and public spaces may be made.

Further embodiments can include two or more distinct compartments rather than a single chamber 101-2. At least one, and possibly (though not necessarily) all of the compartments can be refrigerated as described above. The number of distinct compartments can vary based on the number of different waste items requiring sorting. Each non-refrigerated volume is contained by a removable bin that holds provisions such as clips or holes to retain a waste bag to the shape of the bin. Each non-refrigerated compartment may also contain a lid, opening, trap door, or simple opening, and a means to access such as a pedal, linked to the lid by a mechanical linkage, a proximity sensor or contact motivated by electromechanical means, similar to existing multi-compartment waste receptacles found in the marketplace.

In other embodiments, the removable bin (e.g. the cart 121*c*) may tilt outwards rather than being removed entirely from the container 101*c*). Other modifications may also be made to the embodiments described herein; for example, an outdoor implementation of an actively cooled waste receptacle may be provided as an insulated dumpster, with a sufficiently robust exterior to resist damage from animals and the elements.

The scope of the claims should not be limited by the embodiments set forth in the above examples, but should be given the broadest interpretation consistent with the description as a whole.

The invention claimed is:

1. An actively cooled waste receptacle, comprising:

an insulated container including (i) an inner wall defining a chamber having an opening for receiving the waste, and (ii) an outer wall surrounding the inner wall and joined to the inner wall at the opening;

a cover configured to prevent access to the chamber via the opening in a closed position, and to allow access to the chamber via the opening in an open position; and a heat pump including an interior heat exchanger exposed to the chamber, the heat pump configured to cool the chamber by absorbing heat from air within the chamber via the interior heat exchanger, and transferring the heat outside the insulated container;

a heating element affixed directly to a surface of the interior heat exchanger, the heating element configured to be selectively enabled for defrosting the interior heat exchanger;

a controller connected to the heating element, and configured to automatically enable the heating element responsive to detecting that a defrost condition is satisfied;

a drain extending from a drain inlet in the inner wall to a drain outlet in the outer wall, for directing defrost runoff fluid from the interior heat exchanger to the exterior of the insulated container; and a drainage trough defined in the inner wall and containing the drain inlet.

2. The actively cooled waste receptacle of claim 1, further comprising a fan mounted in the chamber, configured to circulate the air within the chamber.

3. The actively cooled waste receptacle of claim 1, further comprising a mounting member supporting the interior heat exchanger spaced apart from the inner wall.

4. The actively cooled waste receptacle of claim 3, the interior heat exchanger having a planar configuration substantially parallel with a surface of the inner wall.

5. The actively cooled waste receptacle of claim 1, the interior heat exchanger having a substantially vertical orientation.

6. The actively cooled waste receptacle of claim 2, further comprising:

a duct having an inlet and an outlet; the fan configured to draw air from the chamber into the duct for return to the chamber at the outlet.

7. The actively cooled waste receptacle of claim 6, wherein the outlet of the duct is disposed adjacent to the interior heat exchanger, to direct air onto the interior heat exchanger.

8. The actively cooled waste receptacle of claim 6, the duct being disposed between the inner wall and the outer wall; wherein the inlet and the outlet of the duct extend through the inner wall.

9. The actively cooled waste receptacle of claim 6, the duct being disposed within the cover; wherein the inlet and the outlet of the duct extend through an inner surface of the cover.

10. The actively cooled waste receptacle of claim 1, the controller further configured to automatically enable the heat pump to maintain an interior temperature of the chamber below a threshold.

11. The actively cooled waste receptacle of claim 10, wherein the threshold is at or below the freezing temperature of water.

12. The actively cooled waste receptacle of claim 1, further comprising:

a removable bin having a loaded position within the chamber for receiving and holding the waste, and an unloaded position removed from the chamber.

13. The actively cooled waste receptacle of claim 12, further comprising:

a guide structure within the chamber for aligning the removable bin in the loaded position.

14. The actively cooled waste receptacle of claim 13, the guide structure including a protrusion extending into the chamber from the inner wall, and wherein the removable bin includes a complementary indentation configured to engage with the protrusion for aligning the removable bin.

15. The actively cooled waste receptacle of claim 13, the guide structure including a raceway defined on a lower surface of the inner wall, for receiving and guiding a locomotive device mounted to the removable bin.

16. The actively cooled waste receptacle of claim 12, further comprising:

a secondary opening in the insulated container, configured for loading and unloading of the removable bin; and a secondary cover configured to prevent access to the chamber via the secondary opening in a closed position, and to allow access to the chamber via the secondary opening in an open position.

17. The actively cooled waste receptacle of claim 12, the removable bin configured to receive a waste collection bag therein; the removable bin including a retainer for gripping a portion of the waste collection bag.

18. The actively cooled waste receptacle of claim 12, at least a portion of the removable bin being perforated.

19. The actively cooled waste receptacle of claim 1, the cover being movably coupled to the insulated container for moving between the open and closed positions.

20. The actively cooled waste receptacle of claim 1, the cover being fixed to a supporting structure, and the insulated container being movable relative to the supporting structure for placing the cover in the open and closed positions.

21. The actively cooled waste receptacle of claim 1; the heat pump further comprising:

an exterior heat exchanger disposed outside the insulated container and connected to the interior heat exchanger through the inner and outer walls; the exterior heat exchanger configured to exhaust the heat absorbed by the interior heat exchanger.

22. The actively cooled waste receptacle of claim 21, the interior heat exchanger comprising an evaporator and the exterior heat exchanger comprising a condenser.

23. The actively cooled waste receptacle of claim 22, the heat pump further comprising:

a compressor disposed outside the insulated container and connected between the interior heat exchanger and the exterior heat exchanger.

24. The actively cooled waste receptacle of claim 1, the heat pump comprising a thermoelectric heat pump.

* * * * *